US008763296B1

(12) United States Patent
Chvala

(10) Patent No.: US 8,763,296 B1
(45) Date of Patent: Jul. 1, 2014

(54) ADJUSTABLE CHEEK REST ASSEMBLY FOR A FIREARM STOCK

(71) Applicant: Advanced Technology International USA, LLC, Milwaukee, WI (US)

(72) Inventor: John R. Chvala, Grafton, WI (US)

(73) Assignee: ATI IP, LLC, Cedarburg, WI (US)

( * ) Notice: Subject to any disclaimer, the term of this patent is extended or adjusted under 35 U.S.C. 154(b) by 0 days.

(21) Appl. No.: 13/832,568

(22) Filed: Mar. 15, 2013

(51) Int. Cl.
*F41C 23/14* (2006.01)

(52) U.S. Cl.
USPC ..... 42/73

(58) Field of Classification Search
USPC ..... 42/73, 74, 71.01, 94
See application file for complete search history.

(56) References Cited

U.S. PATENT DOCUMENTS

| | | | | | |
|---|---|---|---|---|---|
| 717,011 | A | * | 12/1902 | Marsland et al. | 42/71.01 |
| 2,991,579 | A | * | 7/1961 | Lies | 42/94 |
| 3,710,496 | A | * | 1/1973 | Packmayr et al. | 42/71.01 |
| 4,025,053 | A | * | 5/1977 | Stickle, Jr. | 254/122 |
| 4,117,617 | A | * | 10/1978 | Linde et al. | 42/112 |
| 4,539,769 | A | * | 9/1985 | Stevens et al. | 42/115 |
| 4,580,362 | A | * | 4/1986 | Stevens | 42/1.01 |
| 4,589,219 | A | * | 5/1986 | Milliman | 42/73 |
| 5,576,508 | A | * | 11/1996 | Korpi | 89/36.01 |
| 6,860,055 | B1 | * | 3/2005 | Walrath | 42/94 |
| 7,640,688 | B2 | | 1/2010 | Oz | |
| 7,810,270 | B2 | | 10/2010 | Fitzpatrick et al. | |
| 7,930,849 | B2 | | 4/2011 | Abraham et al. | |
| 7,984,580 | B1 | | 7/2011 | Giauque et al. | |

* cited by examiner

*Primary Examiner* — Jonathan C Weber
(74) *Attorney, Agent, or Firm* — Andrus Intellectual Property Law, LLP

(57) ABSTRACT

An adjustable cheek rest assembly for a firearm includes a stock adapted to be mounted on a support member of the firearm, and a cheek rest disposed in overlying relationship to the stock. A cheek rest adjustment arrangement is connected between the stock and the cheek rest and includes a movable linkage for enabling adjustment of the cheek rest relative to the stock.

8 Claims, 6 Drawing Sheets

ADJUSTABLE CHEEK REST ASSEMBLY FOR A FIREARM STOCK

BACKGROUND OF THE INVENTION

The present disclosure relates generally to firearms, and more particularly, pertains to an adjustable cheek rest assembly for a firearm stock used to improve the user's comfort and maximize a shooter's accuracy.

There has been a long-standing recognition as to the desirability of firearms in which the stock can be moved between various positions which provide the shooter with the desired length of pull for comfortable and accurate shooting. The adjustable positioning of the stocks is useful during transport, storage and use of firearms, and is particularly advantageous in certain tactical situations. Sliding stocks are known to have a stock assembly in which a butt stock is slidably adjustable along a fixed support member between one or more collapsed and extended shoulder-engaging positions.

In addition to the length of the butt stock being adjustable, it is also important for the top portion of the butt stock, known as the cheek rest, to be adjustable. Cheek rests are known to be variously adjustable on butt stocks as to quickly and comfortably provide a shooter with proper sight alignment.

Attempts have been made to advance the functionality of the cheek rest assembly to include different adjustable configurations, but have been found not to be reliable and durable over repeated operation. Previous variably configurable cheek rest assemblies have been unsatisfactory due to among other things, numerous pieces or parts which can unreasonably increase the weight of the assembly, problematic assembly and operation, expensive production costs, and susceptibility to dirt and grit encountered in the field which can negatively affect use.

Accordingly, there remains a need to provide a firearm cheek rest assembly which incorporates, in one integrated design, an enhanced adjustable cheek-engaging structure which overcomes the shortcomings of previous designs.

SUMMARY OF THE INVENTION

The present disclosure relates to an adjustable cheek rest assembly for a firearm which includes a stock adapted to be mounted on a support member of the firearm, and a cheek rest disposed in overlying relationship to the stock. A cheek rest adjustment arrangement is connected between the stock and the cheek rest and includes a movable linkage for enabling adjustment of the cheek rest relative to the stock.

In an exemplary embodiment, the movable linkage is an expandable and collapsible scissors linkage. The cheek rest adjustment arrangement includes an adjustment device, and the linkage is movable in response to actuation of the adjustment device. The adjustment device enables incremental adjustment and locking of the cheek rest relative to the stock. The adjustment device is rotatable and includes a cheek wheel coupled to a lift pin operably connected to the linkage. The cheek rest adjustment arrangement permits selective movement of the cheek rest relative to the stock in a substantially vertical direction.

The present disclosure also relates to an adjustable cheek rest assembly for a firearm having a stock adapted to be mounted on a support member of the firearm, and a cheek rest disposed in overlying relationship to the stock. A cheek rest adjustment arrangement is connected between the stock and the cheek rest for selectively adjusting the cheek rest relative to the stock, wherein the cheek rest adjustment arrangement includes an expandable and collapsible linkage which is movable in response to an adjustment device. In the adjustable cheek rest assembly, the linkage includes a set of outer lift links and an inner lift link operably connected together to the stock and the cheek rest by a pivot pin arrangement. The expandable and collapsible linkage provides for vertically adjusting the cheek rest relative to the stock. Rotation of the adjustment device results in incremental adjustment and locking of the cheek rest relative to the stock.

The present disclosure further relates to an adjustable cheek rest assembly for a firearm which includes a stock, and a cheek rest disposed in an overlying relationship to the stock. A cheek rest adjustment arrangement is located intermediate the stock and the cheek rest for selectively adjusting the cheek rest in a substantially vertical direction relative to the stock. The cheek rest adjustment arrangement includes a cheek base attached to the cheek rest, a lift base secured to the stock, an expandable and collapsible scissors linkage connected between the cheek base and the lift base, and a rotatable adjustment device coupled to the expandable and collapsible linkage.

The cheek rest adjustment arrangement includes a pivot pin arrangement for operatively interconnecting the scissors linkage together with the cheek base and the lift base. The scissors linkage includes a pair of outer lift links coupled to an inner lift link. The cheek base and the lift base are provided with hole and slot structure for receiving the pivot pin arrangement. A spring biased detent member is positioned between the cheek base and the rotatable adjustment device. The adjustment device is provided with a series of recesses which are variously engageable with the spring biased detent member. The cheek rest adjustment arrangement further includes a lift pin threadably coupled to the rotatable adjustment device and movably mounted in the slot structure of the lift base. The rotatable adjustment device includes a cheek wheel attached to a lift rod which is threadably engaged with the lift pin. Rotation of the cheek wheel and the lift rod causes movement of the lift pin, and results in movement of the scissor linkage and the cheek rest relative to the stock. The adjustment device is accessible at a rearward end of the lift base.

BRIEF DESCRIPTION OF THE DRAWINGS

The drawings illustrate the best mode presently contemplated in carrying out the disclosure. In the drawings.

DETAILED DESCRIPTION OF THE INVENTION

Figure 1:
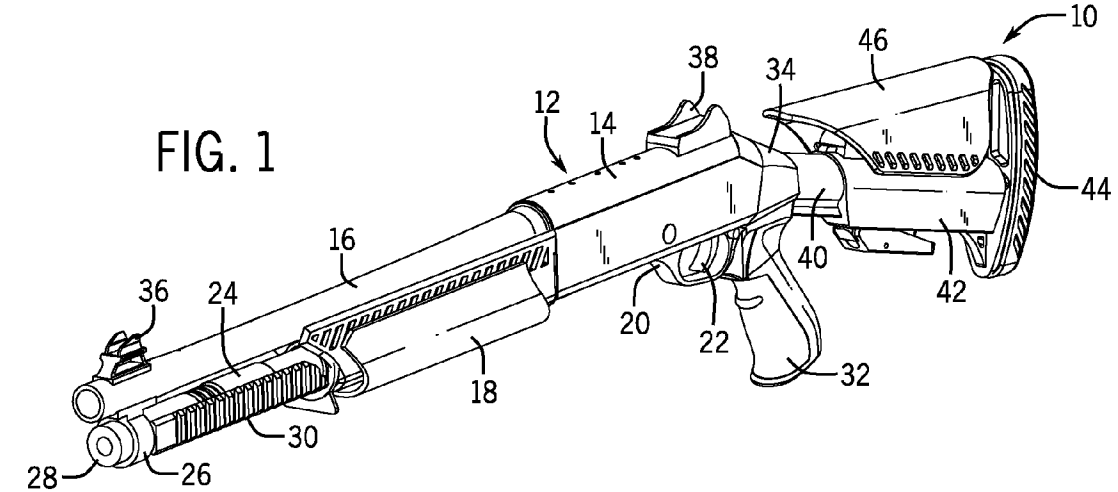
FIGS. 1 and 2 are perspective views of a shotgun provided with a stock and cheek rest assembly.
Figure 2:
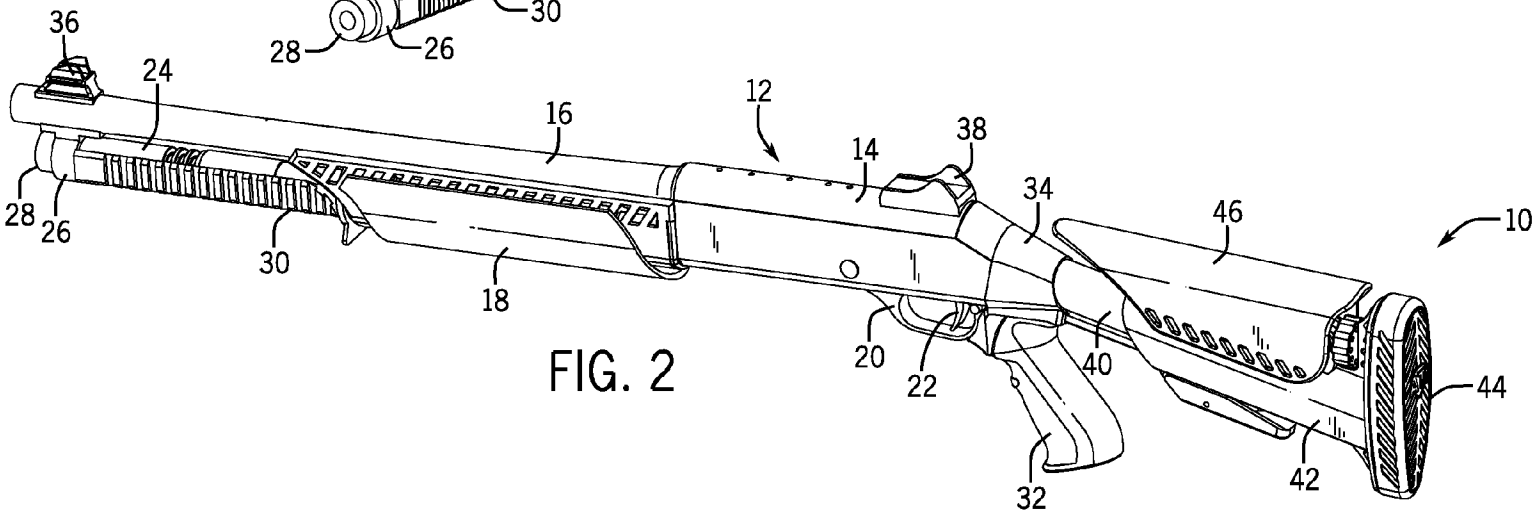

Referring now to the drawings, FIGS. 1 and 2 illustrate a stock and cheek rest assembly 10 movably attached relative to a rear portion of a firearm, such as a semi-automatic shotgun 12.

Shotgun 12 typically includes a receiver 14, a barrel 16, a gripping forend 18, a trigger guard 20 and a trigger 22. The shotgun 12 shown also includes a cartridge-storing magazine tube 24 that extends longitudinally forward of the receiver 14 and below the barrel 16. A forward portion of the magazine tube 24 engages a barrel lug 26 and is held thereto by a magazine cap 28. An accessory mounting rail 30 is provided alongside magazine tube 24. In addition, shotgun 12 is provided with a pistol grip assembly formed by a pistol grip 32 and a mounting device 34, and connected below and at the rear of receiver 14. A forward sight 36 is located adjacent a front upper end of barrel 16, and a rearward sight 38 is positioned on a back upper end of receiver 14.

In accordance with the present disclosure, the stock and cheek rest assembly 10 is generally comprised of a stationary stock support or buffer tube 40 extending rearwardly and downwardly from the receiver 14 and passing through the mounting device 34, a stock 42 mounted for movement on the buffer tube 40, a butt pad assembly 44 secured on a rear end of the stock 42 and an adjustable cheek rest 46 movably mounted on the stock 42. As will be further explained below, the stock and cheek rest assembly 10 also includes a cheek rest adjustment arrangement for various height adjustment of the cheek rest 46 relative to the stock 42.

Figure 3:
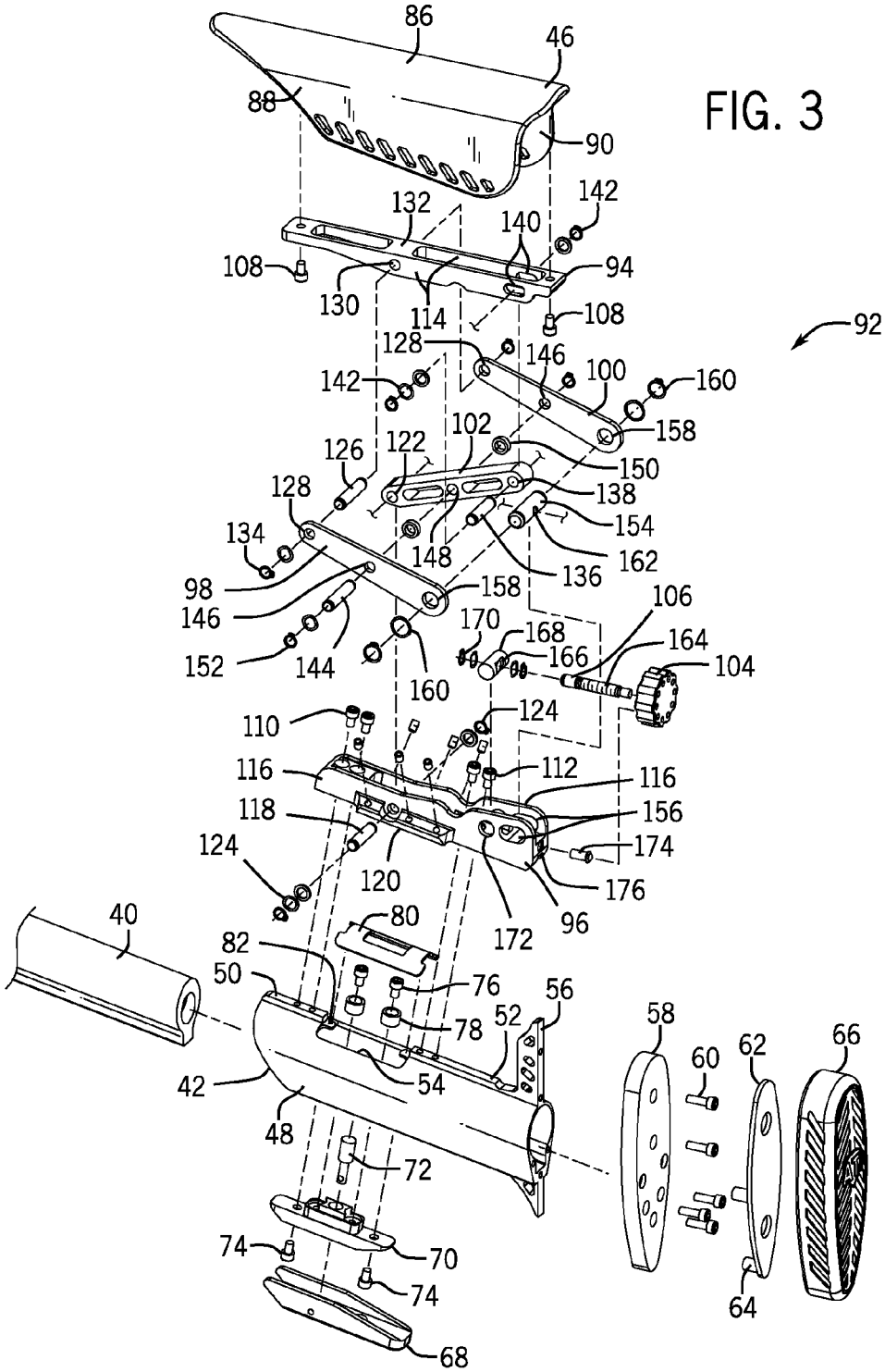
FIGS. 3 and 4 are exploded views of various components defining the stock and cheek rest assembly.
Figure 4:
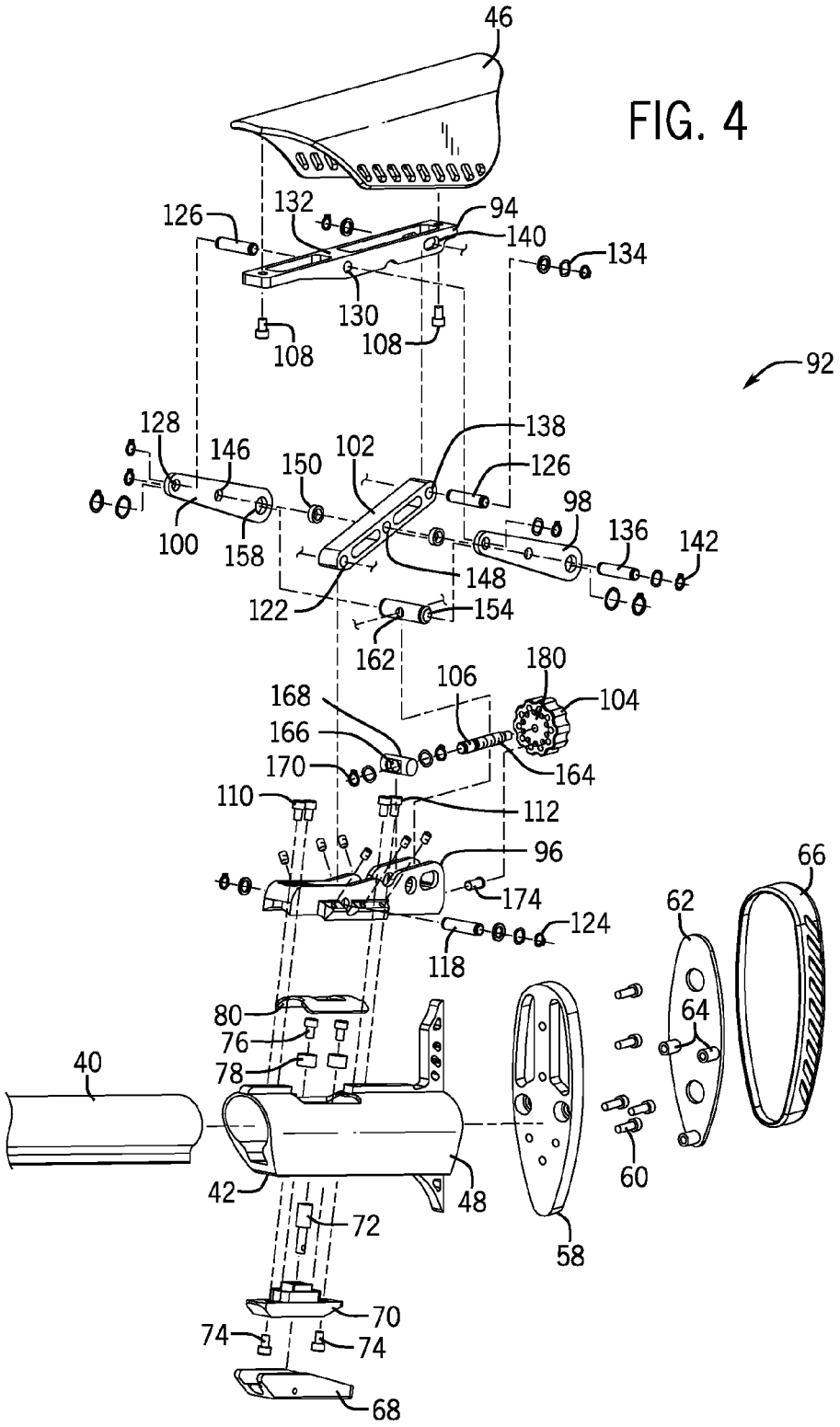

Referring now to FIGS. 3 and 4, the stock 42 has a tubular body 48 with open front and rear ends designed to be slidably mounted on an outer surface of the buffer tube 40. The stock body 48 has front and rear mounting rails 50, 52, respectively, provided on either side of an upper opening 54, and a vertically extending mounting fin 56 at the rear end. The butt pad assembly 44 includes a butt plate 58 which is secured to walls of various apertures formed on the mounting fin 56 and the rear end of the stock body 48 by fasteners 60. The butt pad assembly 44 further includes a butt pad insert 62 coupled frictionally by projections 64 to butt plate 62, and a butt pad 66 which is attached to the butt plate 62 and is adapted to engage the shoulder of the shooter during use of the shotgun 12 as is well known. A lever 68, a lever base 70 and latch pin 72 are designed to be mounted at the bottom of the stock body 48 using fasteners 74, 76 and bumpers 78. The lever 68, the lever base 70 and the latch pin 72 are used to selectively engage various recesses on the bottom of the buffer tube 40 to establish positioning the stock 42 in different locations along an axis of the buffer tube 40. A curved apertured plate 80 is supported by tabs 82 on the top of the stock 42 over opening 54.

The adjustable cheek rest 46 has a top wall 86 and depending side walls 88, 90 which form a saddle-shaped body designed to overlie the stock 42. An outer periphery of the cheek rest 46 can be provided with a soft surface to comfortably cushion the cheek of a shooter during the use of the shotgun 12.

Figure 5:
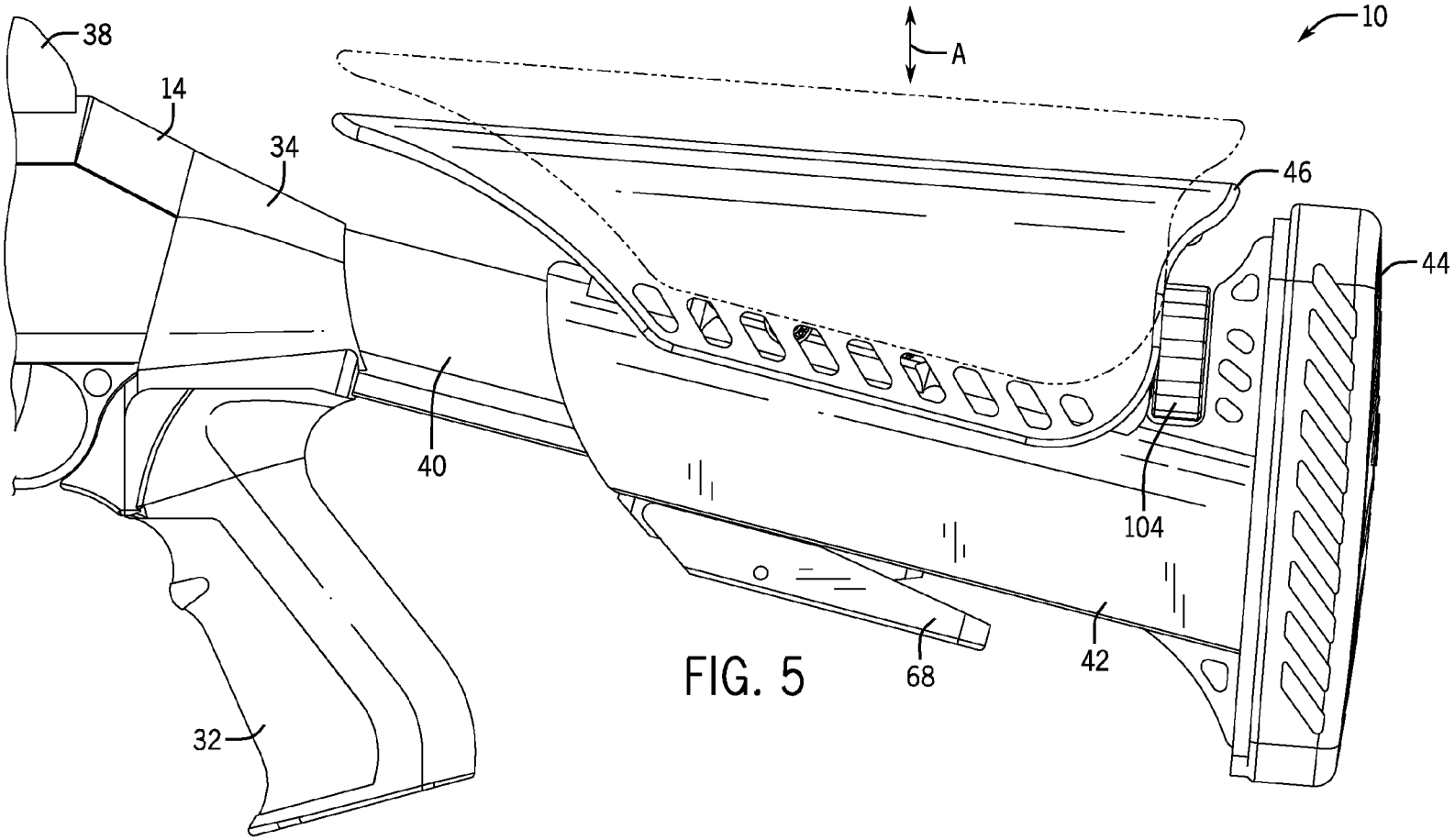
FIG. 5 is an enlarged, fragmentary elevational view of the stock and cheek rest assembly showing an adjustable cheek rest in a first, lowered position as shown in solid lines, and a second, raised position as shown in dotted lines.

A key feature of the assembly 10 is a cheek rest adjustment arrangement 92 located between the stock 42 and the cheek rest 46 for providing height or vertical adjustment of the cheek rest 46 relative to the stock 42. As depicted in FIG. 5, the cheek rest adjustment arrangement 92 permits selective incremental movement of the cheek rest 46, such as between a first or lowered position shown in solid lines, and a second or raised position shown in dotted lines in upward and downward directions depicted by double ended arrow A.

The cheek rest adjustment arrangement 92 includes a cheek base 94, a lift base 96 and set of cooperating outer lift links 98, 100 and a central or inner lift link 102 which are interconnected together to form an expandable and collapsible scissors linkage. The cheek rest adjustment arrangement 92 also includes an adjustment device defined by a cheek wheel 104 and lift rod 106 which are joined together and operatively coupled to the scissors linkage. As will be appreciated hereafter, the scissors linkage is expanded and collapsed to control height adjustment of the cheek rest 46 relative to the stock 42 in response to rotational movement of the adjustment device 104, 106.

Figure 6:
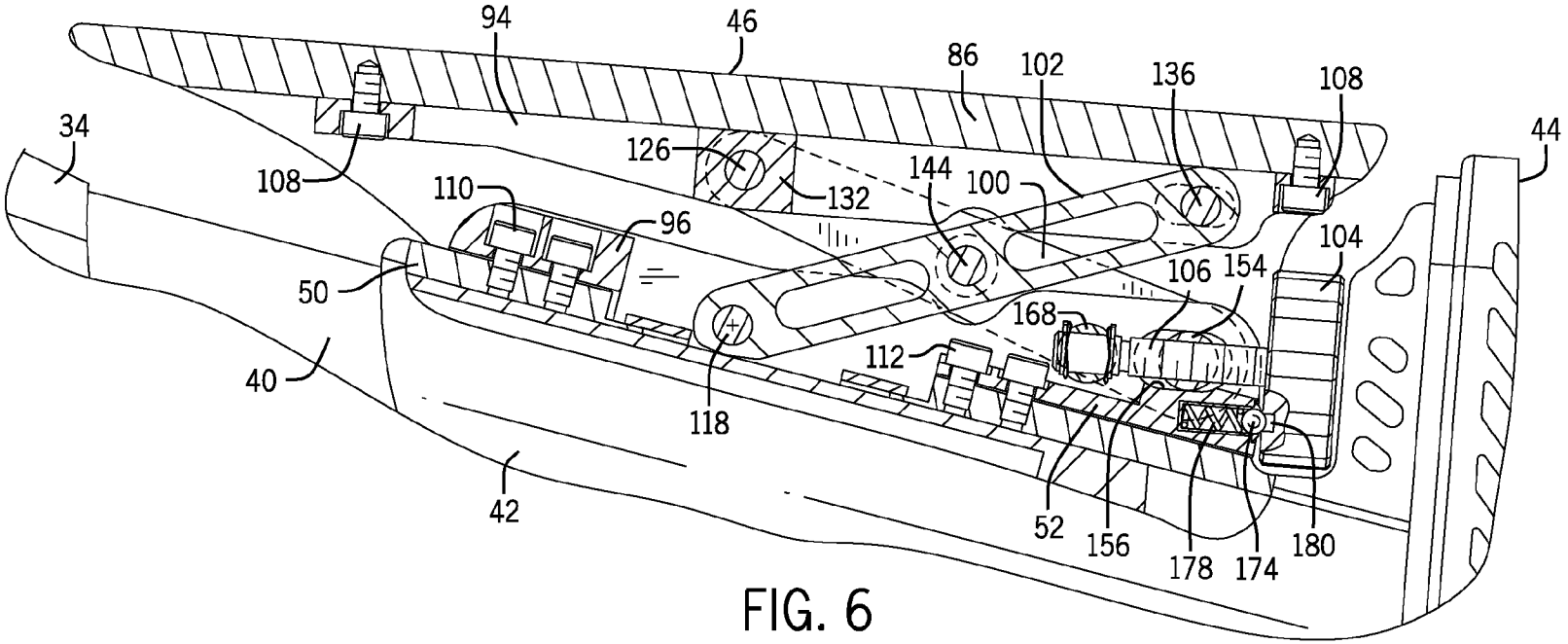
FIG. 6 is a partial sectional view of FIG. 5 illustrating the adjustable cheek rest in the first position.
Figure 7:
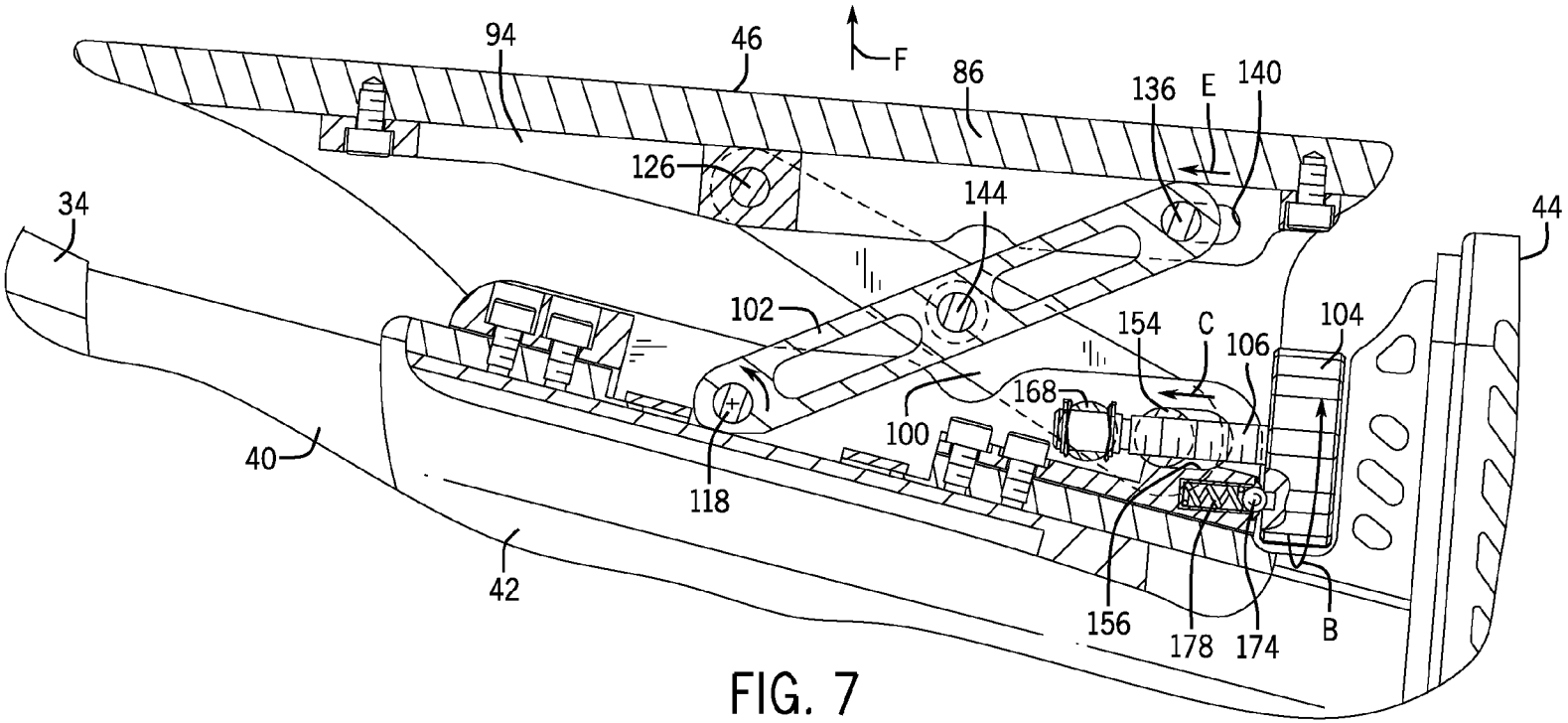
FIG. 7 is a sectional view similar to FIG. 6 illustrating the adjustable cheek rest in the second position.

Referring also to FIGS. 6 and 7, forward and rearward ends of cheek base 94 are fixedly attached to an underside of the cheek rest top wall 86 and between side walls 88, 90 by fasteners 108. The lift base 96 has forward and rearward ends secured to the mounting rails 50, 52 of stock 42 by fasteners 110, 112. The cheek base 94 and the lift base 96 have spaced apart sidewalls 114, 116, respectively, variously configured with aligned throughholes and slots to facilitate a pivotal attachment of the lift links 98, 100, 102 thereto via a set of pivot and lift pins. Outer lift links 98, 100 are pivotally mounted outside the sidewalls 114, 116, while inner lift link 102 is pivotally mounted within the sidewalls 114, 116.

The pivotal mounting includes a first pivot pin 118 that passes through aligned holes 120 in lift base 96, and through a hole 122 on a forward end of inner link 102. The pin 118 is held in place by retainers 124.

A second pivot pin 126 is received through aligned holes 128 in forward ends of the outer links 98, 100, and a throughhole 130 formed through a medial portion 132 of the cheek base 94. The pin 126 is held in place by retainers 134.

A third pivot pin 136 passes through a hole 138 in a rearward end of inner link 102, and aligned slots 140 formed in a rearward end of the cheek base 94. The pin 136 is designed to move back and forth in the slots 140 during height adjustment of cheek rest 46. The pin 136 is held in place by retainers 142.

A fourth pivot pin 144 is received through aligned holes 146 in center portions of outer links 98, 100, and a center hole 148 in inner link 102. The pin 144 also passes through a pair of spacers 150 positioned between outer side surfaces of inner link 102 and inner side surfaces of outer links 98, 100. The pin 144 is held in place by retainers 152.

A lift pin 154 extends through aligned slots 156 formed in a rearward end of the lift base 96, and through aligned holes 158 formed in rearward ends of the outer links 98, 100. The pin 154 is designed to move back and forth in the slots 156 during height adjustment of the cheek rest 46. The lift pin 154 is held in place by retainers 160.

The lift pin 154 has a threaded hole 162 formed transversely therethrough which receives a threaded portion 164 on the lift rod 106 that is fixed to the cheek wheel 104 for rotation therewith. The cheek wheel 104 is accessible outside the rear end of the lift base 96. An outer end of the lift rod 106 is received in a hole 166 formed transversely through an anchor pin 168, and held in place by retainers 170. Outer ends of the anchor pin 168 are engaged with walls forming aligned holes 172 towards the rearward end of the lift base 96. A detent pin 174 is received in a recess 176 at the rear of the lift base 96, and is surrounded by a spring 178 (FIGS. 6 and 7) which normally biases the ball shaped head of the pin 174 into engagement with one of a set of mating recesses 180 (FIG. 4) formed in a face of the cheek wheel 104.

FIG. 6 illustrates the cheek rest 46 in a lowered position with the scissors linkage formed by links 98, 100, 102 and operatively coupled to the lift rod 106 and cheek wheel 104 in a collapsed condition. The cheek rest 46 is normally held or locked in such position by virtue of the engagement of the spring biased detent pin 174 with the walls of the recess 180 formed in the base of the cheek wheel 104.

When it is desired to vertically adjust the cheek rest 46, such as from the position of FIG. 6, the cheek wheel 104 is rotated in the direction of arrow B shown in FIG. 7 to overcome the spring force imposed on detent pin 174. This turning motion causes the lift pin 154 to move forward in the slots 156 of lift base 96 in the direction of arrow C. At the same time, the forward end of the lift link 102 pivots about pivot pin 118 in the direction of arrow D, the rearwards ends of outer links 98, 100 pivot about the lift pin 154 and pivot pin 136 moves forwardly in slots 140 of cheek base 94 in the direction of arrow E. As a result, the scissors linkage 98, 100, 102 expands and effectively lifts the cheek rest 46 upwardly in the direction of arrow F to the raised position depicted in FIG. 7.

It should be appreciated that the cheek wheel 104 can be rotated as desired to enable incremental adjustment and locking of cheek rest 46 relative to the stock 42. The spring biased engagement of the cheek wheel 104 maintains the height adjustment of cheek rest 46 despite recoil forces encountered during discharge of the shotgun 12, and provides a tactile feel to the user during the desired adjustment.

Various alternatives are contemplated as being within the scope of the following claims particularly pointing out and distinctly claiming the subject matter regarded as the invention.

What is claimed is:

1. An adjustable cheek rest assembly for a firearm comprising:

a stock;

a cheek rest disposed in overlying relationship to the stock; and a cheek rest adjustment arrangement located intermediate the stock and the cheek rest for selectively adjusting a position of the cheek rest in a substantially vertical direction relative to the stock, wherein the cheek rest adjustment arrangement includes a cheek base attached to the cheek rest, a lift base fixed to the stock, an expandable and collapsible scissors linkage connected between the cheek base and the lift base, and a rotatable adjustment device coupled to the expandable and collapsible linkage and formed with a cheek wheel attached to a lift rod having a threaded portion, wherein the lift base includes a forward end, a rearward end and a pair of spaced apart vertical sidewalls begin formed with a first pair of aligned holes towards the forward end thereof, a second pair of aligned holes towards the rearward end thereof, and a pair of aligned slots located rearwardly of the second pair of aligned holes, wherein the scissors linkage includes a pair of outer lift links coupled to an inner lift link, the outer and inner lift links having respective forward ends and rearward ends pivotally connected directly to the cheek base and the lift base by a pin arrangement, wherein the pin arrangement includes a lift pin which extends through the aligned slots formed in the rearward end of the lift base, and through aligned holes formed in the rearward ends of the outer lift links, the lift pin being configured to be movable within the aligned slots in the lift base during adjustment of the position of the cheek rest, the lift pin being formed transversely therethrough with a threaded hole which directly receives the threaded portion of the lift rod, and wherein rotation of the cheek wheel and the lift rod causes movement of the lift pin within the aligned slots formed in the rearward end of the lift base resulting in the rearward ends of the outer lift links pivoting about the lift pin and subsequent movement of the scissors linkage and the cheek rest relative to the stock.

2. The adjustable cheek rest assembly of claim 1, wherein a spring biased detent member is positioned between the cheek base and the rotatable adjustment device.

3. The adjustable cheek rest assembly of claim 2, wherein the adjustment device is provided with a series of recesses which are variously engageable with the spring biased detent member.

4. The adjustable cheek rest assembly of claim 1, wherein the adjustment device is accessible at a rearward end of the lift base.

5. The adjustable cheek rest assembly of claim 1, wherein the cheek base includes a forward end, a rearward end and a pair of vertical spaced apart sidewalls being formed with a throughhole medially therethrough, and a pair of aligned slots in the rearward end thereof.

6. The adjustable cheek rest assembly of claim 5, wherein the outer lift links are pivotally mounted outside the sidewalls of the lift base and the cheek base, and the inner lift link is pivotally mounted within the sidewalls of the lift base and the cheek base.

7. The adjustable cheek rest assembly of claim 1, wherein the lift rod has an outer end which is received in a hole formed transversely in an anchor pin retained in the second pair of aligned holes formed in the sidewalls of the lift base.

8. The adjustable cheek rest assembly of claim 1, wherein the cheek wheel is positioned between the rearward end of the lift base and a rearward end of the stock.

* * * * *